United States Patent [19]

Rushing

[11] Patent Number: 4,764,999

[45] Date of Patent: Aug. 23, 1988

[54] HYDROTHERAPEUTIC JET APPARATUS

[76] Inventor: Christopher Rushing, 3040 Carleen Dr., Castro Valley, Calif. 94546

[21] Appl. No.: 18,030

[22] Filed: Feb. 24, 1987

[51] Int. Cl.[4] ..... A61H 33/00

[52] U.S. Cl. ..... 4/542; 239/102.1

[58] Field of Search ..... 4/542, 492; 128/66; 239/102.1, 48.5; 261/DIG. 75

[56] References Cited

U.S. PATENT DOCUMENTS

| | | | |
|---|---|---|---|
| 2,418,045 | 3/1947 | Neider | 239/251 X |
| 2,587,335 | 2/1952 | Landergott | 4/542 |
| 2,591,252 | 4/1952 | Gilson | 4/542 |
| 3,874,374 | 4/1975 | Jacuzzi | 128/66 |
| 3,874,595 | 4/1975 | Rindisbacher | 239/102.1 X |
| 4,339,833 | 7/1982 | Mandell | 4/542 |
| 4,456,174 | 6/1984 | Neenan | 4/428.5 X |
| 4,502,168 | 3/1985 | Jaworski | 4/496 |
| 4,523,340 | 6/1985 | Watkins | 4/542 |
| 4,525,881 | 7/1985 | Higginbotham | 4/496 |

FOREIGN PATENT DOCUMENTS

| | | | |
|---|---|---|---|
| 752745 | 2/1967 | Canada | 239/102.1 |
| 0478621 | 7/1975 | U.S.S.R. | 239/102.1 |

OTHER PUBLICATIONS

Spa and Sauna 1987, Buyers Guide, Hydro'ssage.

*Primary Examiner*—Charles E. Phillips
*Attorney, Agent, or Firm*—Douglas E. White

[57] ABSTRACT

The mechanism of the present invention provides jet sprays of mixed water and air which continuously sweep up and down the spine of the user as he/she sits in the spa. The jets undergo a partial rotation about pivots in arcs of about ¼ or ⅓ of a circle and then reverse and return. These arcs of spray direct the spray directly against the user's back in their midpoint of rotation and obliquely at the end points. Thus, the pressure of spray as felt by the user is continuously changing. This motion is accomplished by an impeller and worm gear arrangement which converts the energy of the water which is flowing to the jets.

9 Claims, 3 Drawing Sheets

HYDROTHERAPEUTIC JET APPARATUS

FIELD OF THE INVENTION

This invention relates to therapeutic and recreational spas and hot tubs, more particularly to jets which spray a mixture of water and air into the water filled interior of the spa.

BACKGROUND OF THE INVENTION

Most existing water jets in spas or "hot tubs" are fixed, i.e. their direction of spray remains constant. One jet is known which uses a flexible pipe for a nozzle. This causes a spray which flops about unpredictably due to hydraulic forces in much the same way as a loose water hose. This flexible pipe jet is marketed by Watkins Hot Springs Co. under the trademark MOTO JET.

U.S. Pat. No. 4,339,833 of G. Mandell teaches a reciprocating hydro-massage apparatus where the flow moves up and down on a helical track screw. The whole apparatus, pipes, impeller and all, moves up and down the screw. Such an apparatus is prone to failure due to corrosion of the drive screw and incorporates an electric motor which requires elaborate precautions to prevent shock in the aquatic environment of spas. Another embodiment uses a mechanical impeller whose weight is likely to damage the track of the screw. The Mandell mechanism, while reciprocating, does not impart an arcuate motion to the spray and uses only one nozzle.

There exists a need for water jets which move their spray in a fixed pattern up and down the user's spine in the manner of a human masseuse. Specifically, it is desired to provide a spa jet system which "massages" the entire back of a user in a systematic manner which is conducive to relaxation and as therapy for chronic back pain.

SUMMARY OF THE INVENTION

The mechanism of the present invention provides jet sprays of mixed water and air which continuously sweep up and down the spine of the user as he/she sits in the spa. The jets undergo a partial rotation about pivots in arcs of about $\frac{1}{4}$ or $\frac{1}{3}$ of a circle and then reverse and return. These arcs of spray direct the spray directly against the user's back in their midpoint of rotation and obliquely at the end points. Thus, the direction and pressure of spray as felt by the user are continuously changing, as well as the point of application of spray. This motion is accomplished by an impeller and worm gear arrangement which converts the energy of the water which is flowing to the jets.

First, the water pressure creates the 360 degree rotational energy of the impeller. Second, the worm gear which is attached to the axis of the impeller rotates an arm of the jet linkage which is connected to a linking arm that translates a third arm linearly. Since the third arm of the linkage is connected to the two jets at a point which is offset from their points of rotation, linear translational movement is converted to back-and-forth arcuate jet motion at the water output of the nozzles.

Water is fed into the impeller, turning it. Water exits the impeller at an outlet which feeds to the two jets at their point of rotation and is mixed with air inside the jets. The water and air then exit the jets and impinge on the user's back, massaging it with a continuous up and down arcuate movement.

The entire apparatus fits into a cavity on a vertical wall of a spa. The jets and their pivots are in a separate cavity which is open to the spa. Since this cavity is below the waterline of the spa, the jets are submerged, as is their spray. The impeller and linkage lie outside of the jet cavity and are not submerged in the water of the spa itself.

FEATURES AND ADVANTAGES

An object of this invention is to provide a hydrotherapeutic jet apparatus with means for rotating a pair of jets about a pivot in the frame of the apparatus.

Another object is to disclose a follower link which connects the jets, enabling them to move in tandem, describing co-planar reciprocating arcs in which the two lines of jet spray are always parallel to each other.

Yet another object is provide jets which are able to rotate about pivot axes. This is accomplished by utilizing hollow pivot bearings which oppose each other on either side of a jet on a single axis. The hollows are used to feed water to the jet on one side and air on the other. The jet has internal passages leading from the pivot bearings to a mixing chamber, enabling the jets to spray a mixture of water and air, or water only, as desired.

A further object is to disclose a mechanical impeller drive means, which does not use electricity, to provide the force used to rotate the jets. Worm gear means is used to reduce the high speed revolutions of the impeller to drive a high torque shaft.

Yet another object is to disclose linkage means which transform the rotation of the drive shaft to translational reciprocating motion of the jets.

It is also an object to disclose a water passageway in the frame of the apparatus which allows the pressurized water that turns the impeller to later be used to form the spray of the jets.

Yet another object is to construct as many parts as possible out of polymer plastic, particularly moving parts and those which contact spa water, in order to reduce damage due to corrosion.

Other novel features which are characteristic of the invention, as to organization and method of operation, together with further objects and advantages thereof will be better understood from the following description considered in connection with the accompanying drawing in which a preferred embodiment of the invention is illustrated by way of example. It is to be expressly understood, however, that the drawing is for the purpose of illustration and description only and is not intended as a definition of the limits of the invention.

DESCRIPTION OF THE PREFERRED EMBODIMENT

Figure 1:
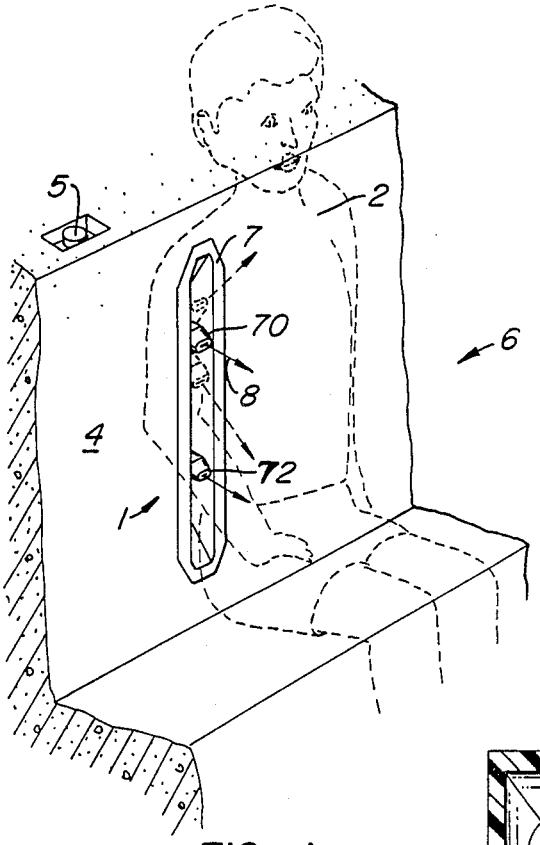
FIG. 1 is a perspective view of a preferred embodiment of jet apparatus of the present invention showing its installation in a spa.

FIG. 1 illustrates use of the hydrotherapeutic jet apparatus 1 of the present invention by a subject 2 shown in phantom. Apparatus 1 is mounted on the wall 4 of a spa 6. The apparatus may be retrofited into any number of spas, hot tubs or bathtubs of conventional design.

Subject 2 may reach control valve 5 to adjust the relative portions of air and water spray 8 exiting the upper 70 and lower 72 jets. The addition of another valve to control 5 would allow the subject to turn the apparatus 1 off and on.

As will be described in detail infra, Apparatus 1 allows jets 70,72 to translate up and down, causing spray 8 to massage the spine of subject 2 in a relaxing and therapeutic manner.

Figure 2:
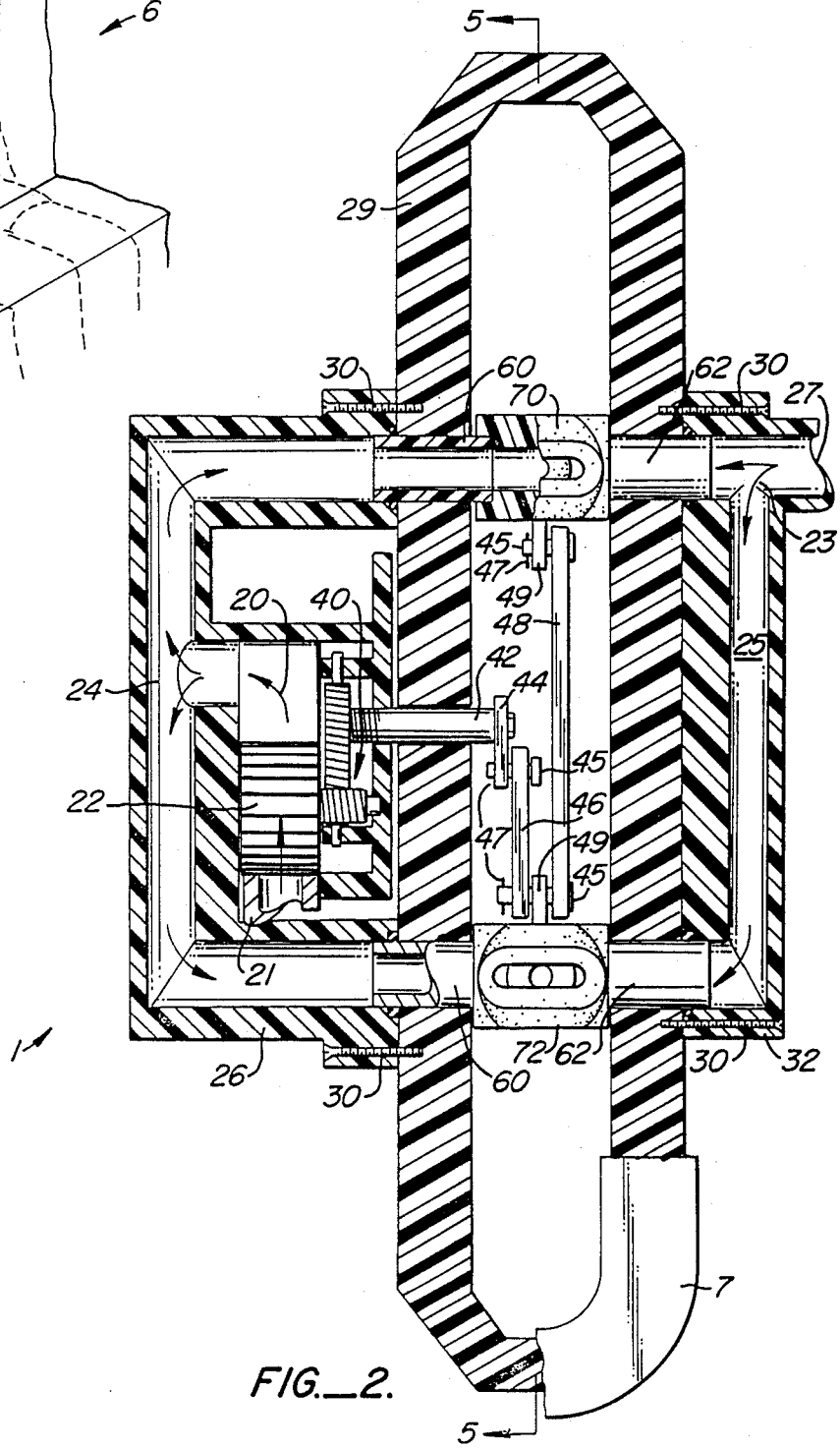
FIG. 2 is a front view of the apparatus of FIG. 1.

Referring to FIG. 2, there is shown therein a cross-section of a front view of jet apparatus 1. Water 20 under pressure enters inlet pipe 21 and passes over the blades of impeller 22, causing it to rotate at a high speed. The water 20 then travels through water transfer pipes 24 to upper 70 and lower 72 jets via cylindrical pivot bearings 60. The location of the common axis of bearings 60,62 within the cavity frame 29 is generally referred to as the "pivot".

Air 23 under pressure enters inlet 27 of air transfer pipes 25. It passes into jets 70,72 via cylindrical pivot bearings 62. Both pairs of pivot bearings 60,62 are disposed co-axially, enabling jets 70,72 to rotate about their common axes.

Water transfer pipes 24 are integral to plastic impeller and water delivery housing 26. Air transfer pipes 25 are integral to plastic air delivery housing 32. Housings 26,32 are bolted to plastic jet cavity frame 29 by means of corrosion resistant metal screws 30. Water and air delivery housings 26,32, taken together with cavity frame 29, are collectively referred to as the "frame" of the apparatus 1.

Figure 3:
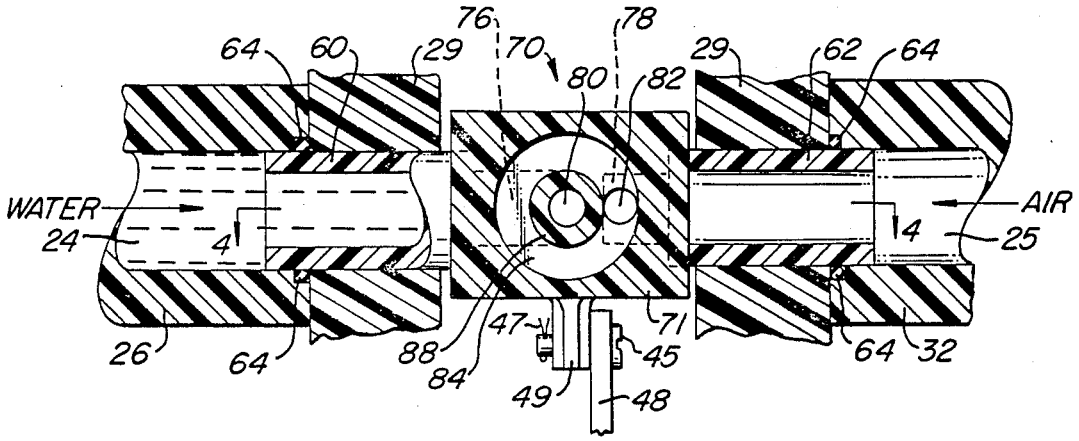
FIG. 3 is a sectional view of an upper jet taken along line 3—3 of FIG. 4.
Figure 4:
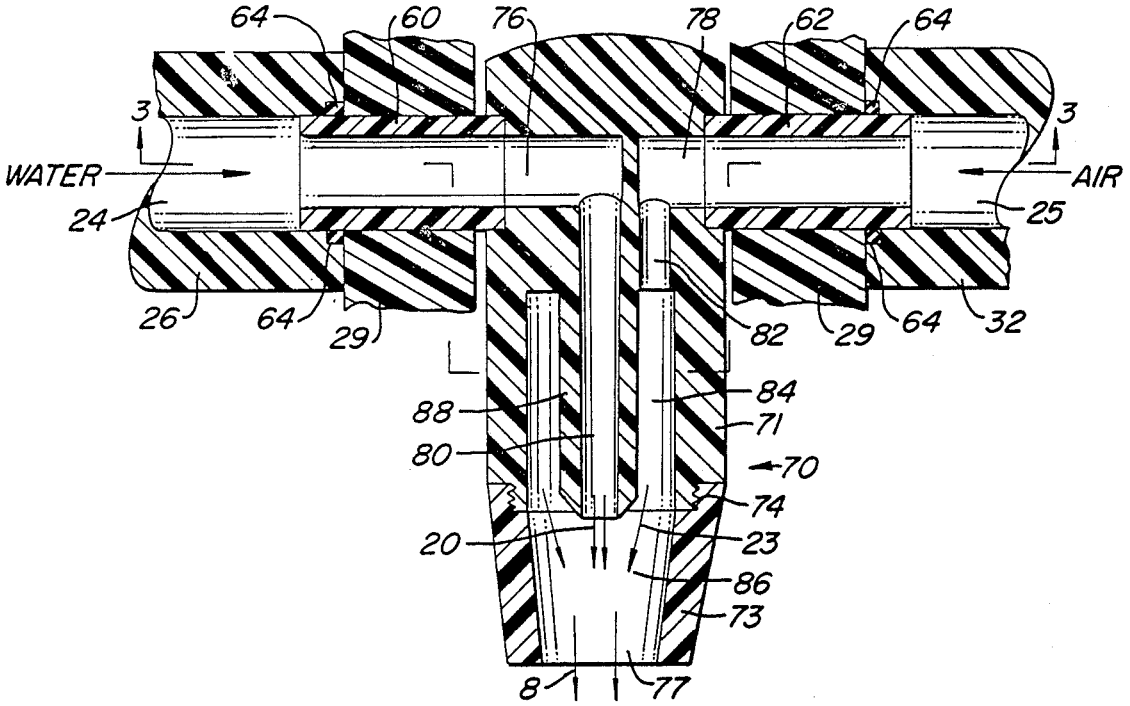
FIG. 4 is a sectional view of the jet of FIG. 3 taken along line 4—4 of FIG. 3.

Leakage due to fluid pressure between housings 26,32 and cavity frame 29 is prevented by O-ring seals 64 (FIGS. 3,4). Cavity frame 29 is mounted into the interior of spa 6 over a hole cut into spa wall 4. Plastic cover plate 7 protects the user 2 from jagged edges of the hole. Bolts (not illustrated) or other fastening means are used to conjoin frame 29, wall 4 and plate 7.

Figure 5:
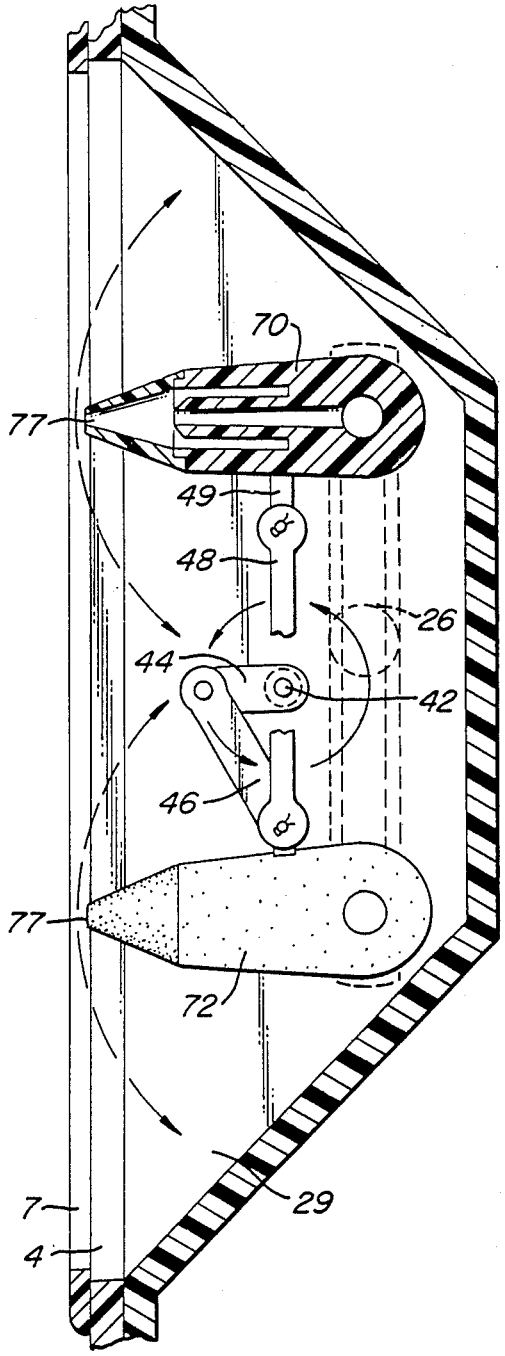
FIG. 5 is a sectional side view taken along line 5—5 of FIG. 2 showing the motion of the jets.

Plastic impeller 22 drives plastic worm reduction gears 40 which convert the impeller's high speed, low torque rotation to low speed, high torque rotation of drive shaft 42. Referring additionally to FIG. 5, it can be seen that shaft 42 converts its 360 degree rotational energy to translational energy of follower link 48. Shaft 42 turns drive link 44 which, in turn, turns one end of transitional link 46 in circles while the other end of link 46 is constrained to translational movement by connection to follower link 48 and to lower jet 72.

Plastic rectilinear linkages 44,46,48 are interconnected by plastic pins 45, which are secured by steel spring clips 45. It is important to note that metal is employed very sparingly throughout the apparatus 1 to limit the damaging effects of highly corrosive spa water. Link 48 is connected by pins 45 to protruding flanges 49 on the sides of jets 70,72. Since jets 70,72 are free to rotate about pivot bearing tubes 60,62, the reciprocating translation of follower link 48 causes their ends to describe short arcs in parallel in a continuous back-and-forth movement. Air and water spray 8 thus messages the back of subject 2 in a relaxing and therapeutic manner.

The unique construction of jets 70,72 which allow them to mix separate lines of air and water while retaining freedom of rotational movement will be discussed with reference to FIGS. 3 and 4.

Let us take, as an example, upper jet 70. Lower jet 72 is of congruent configuration, as would be any additional jets in an apparatus driving a plurality of jets. Jet 70 is free to rotate about pivot bearings 60,62, which are rigidly affixed within housings 26,32 and cavity frame 29 and communicate with water 24 and air 25 transfer pipes, respectively.

Jet 70 may be constructed simply and inexpensively out of just two parts. Block 71 is bored on opposites sides, on the common radial pivot axis, forming axial water passage 76 and axial air passage 78. Passage 76 extends just over half way through block 71, while passage 78 extends less than half way so that the two passages do not interconnect. Each passage 76,78 is widened at the entrance for insertion of bearing tubes 60,62, respectively. Alternatively, bearing tubes 60,62 could be formed as an integral part of jet 70. In such a case, the tubes themselves would rotate within cavity frame 29 about the pivot axis.

Boring perpendicularly transverse to passages 76,78 along the longitudinal axis of block 71 forms longitudinal water passage 80 and longitudinal air passage 82. Passages 80,82 interconnect for fluid communication with passages 76,78, respectively. The upper portion of passage 82 may be widened by circular reaming to form air circulation chamber 84 and water nozzle 88. Cap 73 screws onto block 71 by means of threads 74 to form a water and air mixing chamber 86. Water 20 enters jet 70 via bearing 60, travels through passages 76,80 and enters mixing chamber 86. Air 23 enters jet 70 via bearing 62, and travels through passages 78,82 and circulation chamber 84 before mixing with water 20 in mixing chamber 86. Mixed air and water spray 8 is thus free to exit jet 70 through outlet 77 in a constantly reciprocating arcuate motion.

While the above provides a full and complete disclosure of the preferred embodiments of this invention, various modifications, alternate constructions, and equivalents may be employed without departing from the true spirit and scope of the invention. Therefore, the above description and illustrations should not be construed as limiting the scope of the invention which is defined by the appended claims.

I claim:

1. Hydrotherapeutic jet apparatus including:

a frame having at least one pivot;

at least one fluid jet having a fluid outlet, each jet connected to one pivot of the frame and free to rotate within a plane of rotation about that pivot and to spray fluid within its plane of rotation;

drive means;

an impeller connected to the drive means, the impeller having a plurality of blades for transforming the force of water passing under pressure across the blades into rotational movement of the drive means;

linkage means for transforming the rotational movement of the drive means into reciprocating arcuate movement of the at least one fluid jet;

the drive means is a rotatable drive shaft connected to the impeller; and the linkage means comprises a drive link having a base connected to the drive shaft and having a distal end free to describe a complete circle, and a transitional link having a first end connected to the distal end of the drive link and a second end connected to one jet, the second end free only to describe reciprocating translational movement, whereby rotation of the drive shaft causes the jet to rotate back and forth about one pivot within the plane of rotation of the jet in arcs of less than a full circle.

2. The apparatus of claim 1 wherein there are two jets and further including:

worm gear means connecting the drive shaft to the impeller; and a follower link having a third end connected to one jet and to the second end of the transitional link and the follower link further having a fourth end connected to the second jet, whereby the rotating means causes the two jets to describe reciprocating arcs in parallel.

3. Hydrotherapeutic jet apparatus including:

a frame having at least one pivot;

at least one fluid jet having a fluid outlet, each jet connected to one pivot of the frame and free to rotate about that pivot;

means connected to the frame for rotating the at least one jet about the at least one pivot in a reciprocating arcuate fashion;

first and second hollow cylindrical pivot bearings connected coaxially to opposite sides of each jet and to the frame, within the pivot of the jet;

a water passage within each jet communicating with the first pivot bearing and with the outlet of the jet; and an air passage within each jet communicating with the second opposing coaxial pivot bearing and with the outlet of the jet.

4. The apparatus of claim 3 wherein the rotating means comprises:

worm gear means for reducing rate of rotation;

an impeller having a plurality of blades for transforming the force of water passing under pressure across the blades into rotational movement of the worm gear means; and linkage means for transforming the rotational movement of the worm gear means into reciprocating arcuate movement of the at least one fluid jet.

5. The apparatus of claim 4 further including:

a water passageway extending from the impeller through the first pivot bearing of each jet to the water passage thereof, whereby water passing over the blades of the impeller exits from the outlet of each jet in a reciprocating arcuate spray.

6. The apparatus of claim 5 further including:

an air passageway extending through the second pivot bearing of each jet to the air passage thereof, whereby air and water mixed exit from the outlet of each jet.

7. The apparatus of claim 6 wherein:

the worm gear means directs its rotational movement to a drive shaft and the linkage means comprises a drive link having a base connected to the shaft and having a distal end free to describe a complete circle;

a transitional link having a first end connected to the distal end of the drive link and a second end connected to one jet, the second end free only to describe reciprocating translational movement, whereby rotation of the drive shaft causes the jet to rotate back and forth about one pivot in arcs of less than a full circle.

8. The apparatus of claim 7 wherein there are two jets and further including:

a follower link having a third end connected to one jet and to the second end of the transitional link and further having a fourth end connected to the second jet, whereby the rotating means causes the two jets to describe reciprocating arcs in parallel.

9. Hydrotherapeutic jet apparatus including: a frame having at least two pivots;

at least two fluid jets each having a fluid outlet, each jet connected to one pivot of the frame and free to rotate about that pivot;

means connected to the frame for rotating the at least two jets about the at least two pivots in a reciprocating arcuate fashion; and the at least two jets connected by a follower link, whereby the rotating means causes the at least two jets to describe tandem reciprocating arcs in parallel.

* * * * *